United States Patent [19]

Cole, Jr.

[11] Patent Number: 4,760,505

[45] Date of Patent: Jul. 26, 1988

[54] INDIRECT LIGHTING FIXTURE

[75] Inventor: John M. Cole, Jr., Hingham, Mass.

[73] Assignee: Litecontrol Corporation, Hanson, Mass.

[21] Appl. No.: 45,292

[22] Filed: May 4, 1987

[51] Int. Cl.[4] ..... F21S 3/02; F21V 7/12

[52] U.S. Cl. ..... 362/225; 362/241; 362/260; 362/147

[58] Field of Search ..... 362/225, 241, 260, 147

[56] References Cited

U.S. PATENT DOCUMENTS

| | | | |
|---|---|---|---|
| 2,240,179 | 4/1941 | Doane | 362/225 |
| 2,560,281 | 7/1951 | Doane | 362/225 |
| 3,591,798 | 7/1971 | Florence | 362/225 |
| 4,562,517 | 12/1985 | Pankin | 362/241 |

FOREIGN PATENT DOCUMENTS

| | | | |
|---|---|---|---|
| 3416128 | 11/1985 | Fed. Rep. of Germany | 362/260 |

*Primary Examiner*—Albert W. Davis, Jr.
*Attorney, Agent, or Firm*—Barlow & Barlow, Ltd.

[57] ABSTRACT

An indirect fluorescent luminaire with planar specular reflectors arranged in such a manner as to project its maximum intensity approximately at 130° above nadir to optimize the uniformity of ceiling luminance. The lamps are stacked vertically to further minimize the vertical projection of intensity and enhance the lateral projection. The fixture may be suspended at distances of 12 inches or less from the ceiling without causing excessive luminance on the ceiling above the luminaire or excessive luminance ratios between the brightest area directly over the fixture and a point midway between them.

5 Claims, 2 Drawing Sheets

PRIOR ART

INDIRECT LIGHTING FIXTURE

BACKGROUND OF THE INVENTION

Fluorescent lighting fixtures are in widespread use for providing illumination and have gained great acceptance because of the reduced cost of operation compared with the lumen output of comparable incandescent fixtures. There are, however, many shortcomings in the existing fixtures mainly because of their inefficient use of the available light. For example, it is rather common to utilize a translucent cover over the fixture which, in some instances, tends to disperse the light more evenly in the area illuminated but decreases the lumen output. A further deficiency is found in the manner in which the housings are constructed. The housings, for example, are merely rectangular boxes painted white to reflect some of the light back out into the room, which structure is inefficient.

In the past, there have been some attempts at arranging fluorescent lamps in vertical alignment as, for example, in the Florence Patent. U.S. Pat. No. 3,591,798 and the Doane Patent, U.S. Pat. No. 2,240,179. There has also been some activity at developing indirect lighting fixtures as seen, for example, in the Lewin Patent U.S. Pat. No. 4,388,675 where a plurality of inverted V-channels are positioned behind fluorescent tubes in the fixture. While the prior art patents do offer some interesting approaches with respect to particular situations, none of them individually or in combination disclose or suggest the invention defined by the appended claims.

SUMMARY

An indirect multiple, vertically stacked tube luminaire in a rectangular housing has planar specular reflectors that extend parallel to the tubes and project the light energy at a low angle to achieve an even spread of light over the ceiling. The reflectors are V-shaped and are at an angle so that the light energy for the bottom tube is reflected above the top tube and the light energy from the top tube is directed above itself. This arrangement maximizes the uniformity of ceiling luminance. The resulting fixture efficiency is 89% or higher.

One of the objects of the instant invention to provide a lighting fixture which may be readily fabricated at relatively low cost which will be thinner than existing lighting fixtures and will use standard available one inch diameter fluorescent lamps, the fixture controlling the light emitted therefrom in such a manner that the available illumination is emitted at a low angle.

It is also a general object of the invention to provide a lighting fixture which has two elongated juxtaposed fluorescent lamps that extend parallel to each other in vertical alignment and which are associated with specular reflectors arranged in the fixture so as to emit light at a low angle.

DESCRIPTION OF THE PREFERRED EMBODIMENT

Figure 1:
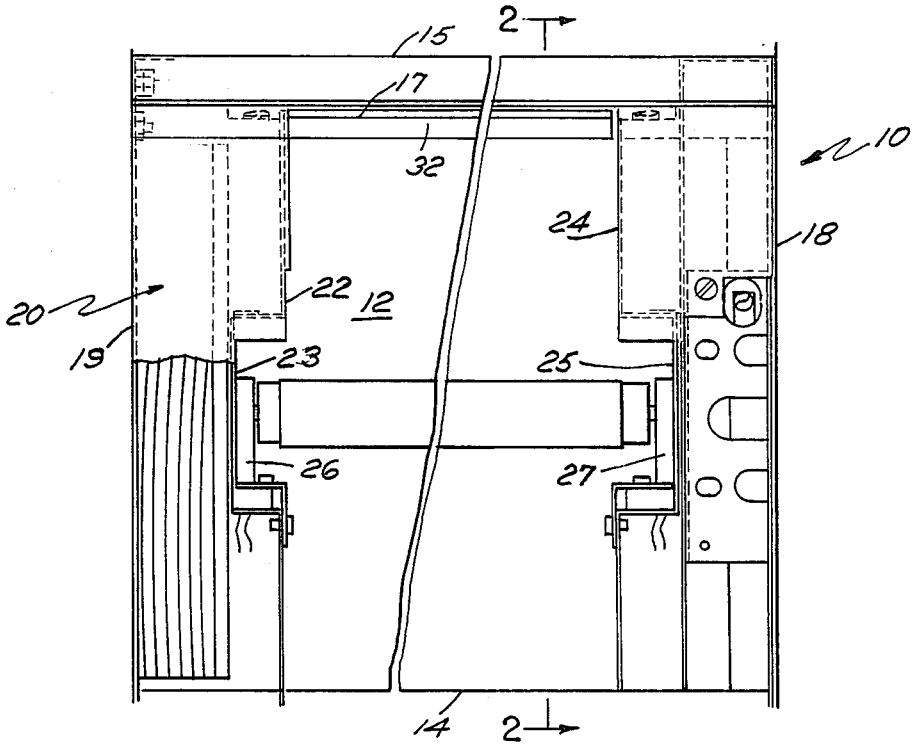
FIG. 1 is a top view of a lighting fixture made in accordance with the invention.

Referring to the drawings, there is illustrated a generally shallow rectangular fixture housing 10 which has flat bottom wall 12 with rising side walls 14, 15. By referring to FIG. 2, it will be seen that the side walls 14 and 15 each terminate in an inwardly bent downwardly directed portions 16 and 17. The fixture is also provided with end walls 18, 19. A ballast compartment generally designated 20 is provided and a pair of inner end walls 22, 24 each have recesses 23, 25 and into these recessed sections are fitted sockets 26, 27 to receive the fluorescent tube. The fluorescent tubes may be of a standard type and are typically 48 inches long although other lengths may be utilized and are commercially available. It will also be noted by referring to the drawing, that the ballast is located in the end of the fixture on its side and transversely to the fixture. In this fashion there is no more than three inches between the end of the socket and the end wall of the fixture. When a plurality of fixtures are mounted end to end, there will be therefore, no more than six inches between the ends of the tube sockets.

Figure 2:
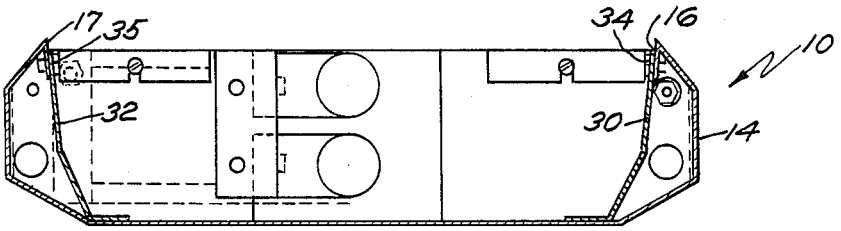
FIG. 2 is a sectional view taken on lines 2—2 of FIG. 1.

Referring specifically to FIG. 2, it will be seen that there are V-shaped side reflectors 30 and 32 which are affixed to the inturned side wall portions 16 and 17, respectively. The upper portion of the reflector is set at an angle to reflect the incident light from the upper lamp in the lowest possible path while the lower portion of the reflector is set to receive the incident ray from the lower lamp in a slightly higher path. By way of example, the upper portion of the reflector is 7° from the vertical, while the lower portion of the reflector is 24° from the vertical. These angles will be valid when the reflector meets the bottom wall 12 and it is approximately 4 inches from the center line of the lamps. The reflector should be a specular reflector and may be of a structure such as is known and sold under the trademark "Alzak". As will be noted, the reflectors 30 and 32 are fastened to the inturned side walls by screws 34, 35.

Figure 3:
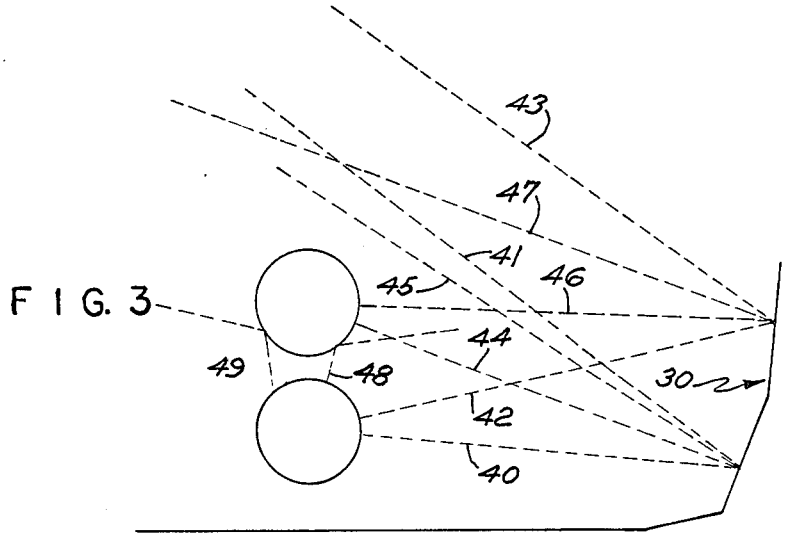
FIG. 3 is a ray diagram of the invention.

Referring now more particularly to FIG. 3, it will be seen that the lower lamp will emit a ray such as 40 which is reflected as a ray 41; similarly a ray 42 from the lower lamp will be reflected by the upper reflector as a ray 43. The upper lamp will have a ray such as 44 that impinges on the lower reflector which will then reflect as a ray 45; similarly, a ray such as 46 from the upper lamp hits the upper reflector and will be reflected off as a ray 47. In addition, the upper lamp redirects the upward light as shown by rays 48, 49. Thus only the flux from the upper lamp is directed toward the ceiling.

Figure 4:
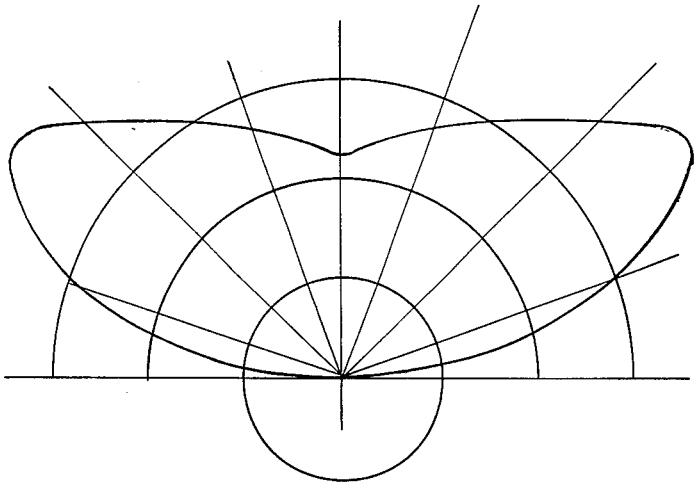
FIG. 4 illustrates the light distribution pattern of the invention.

In essence, the upper reflector is set at an angle to reflect the incident ray of light from the upper lamp in its lowest possible path which does not intercept the upper lamp. Consequently, the incident ray from the lower lamp is reflected in a slightly higher path. To this end, the lower reflector is set at an angle to reflect light of the incident ray from the upper lamp along a path does not intercept either one of the lamps. Noting, for example, in FIG. 4, which illustrates the intensity distribution diagram. The intensity at the zenith is relatively low compared to the maximum intensity which occurs at about 130°. This is advantageous since it is not desired to have any form of a hot spot directly above the fixture.

Figure 5:
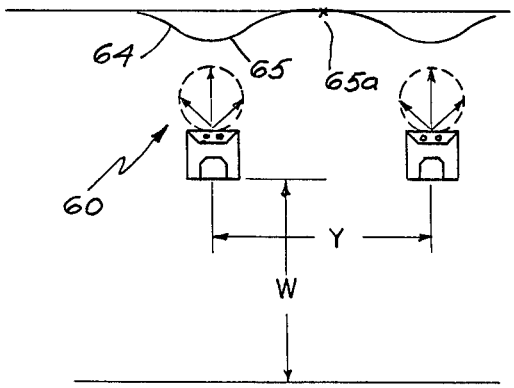
FIG. 5 illustrates a comparison of existing prior art fixtures with the fixtures of the instant invention.
Figure 5:
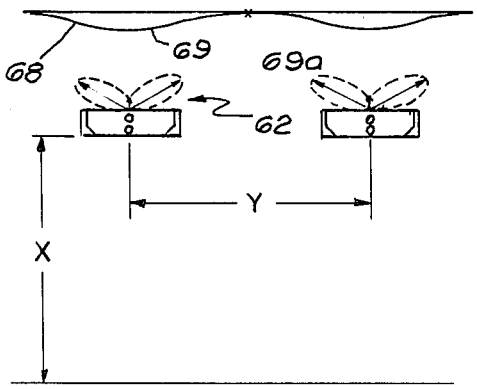

FIG. 5 shows a comparison between the cosine distribution, as indicated generally at 60, which is characteristic of a traditional fixture and the widespread distribution generally indicated 62 that is available with the instant invention. As a further comparison, the line 64 is a plot of luminance of the ceiling over a traditional fixture showing that the luminance is much more pronounced at the point 65 directly over a fixture than at the midpoint, such as 65*a*. Typically, the ratio of the values at point 65 to point 65*a* is excessive with a traditional fixture, that is usually hung about 12 inches below the ceiling. Line 68 is a plot of luminance of the ceiling with the fixture of the instant invention hung about 9" below the ceiling showing that the luminance is only slightly more pronounced at the point 69, directly over the fixture than at the midpoint 69*a*. The ratio of the values between 69 and 69*a* is more acceptable when the fixture of the invention is hung twelve inches or more below the ceiling.

Essentially, what has been achieved here is that instead of the bright area directly above the fluorescent luminaire, the brightness on the ceiling has been minimized directly over the fixture. Also, in the current practice, fixtures are generally six inches deep and, when the fixture is suspended approximately 12 inches, the whole assembly extends 18 inches from the ceiling. Current construction practice commonly employ ceiling heights of 8½ feet, and, therefore, the bottom of the fixture may be 7 feet above the floor. This creates not only a visually undesirable situation but it also is perceived as a threat to tall people. The instant invention lessens the brightness areas of the ceiling by widening the distribution pattern of light and thus permits a shorter stem. The fixture is made shallow by placing the ballast in line with the lamp rather than below the lamp. The beneficial result changes the stem length from 14 inches to 9 inches and the fixture height from 6 inches to 3 inches. Clearance above the finished floor is now 7 foot 6 inches, accomplished with a fixture that is 89% efficient.

I claim:

1. An indirect fluorescent multiple tube light fixture for mounting a distance below a ceiling surface comprising an elongated rectangular housing having a flat bottom wall, linear fluorescent tubes mounted to define a lower tube and an upper tube, V-shaped elongated side reflectors arranged parallel to the tubes, the angle formed by the lower portion and the bottom wall being selected to direct light energy from the lower tube at an angle approximately 130° above nadir and above the upper tube and the angle formed by the upper portion of the reflector being selected to direct light energy at an angle sufficient to clear and be above the upper tube approximately 100° above nadir whereby the flux output of both lamps and reflectors is combined in a beam pattern centered about 130° above nadir and a substantially uniform pattern of luminance is provided on the ceiling.

2. A fixture as in claim 1 wherein the side reflectors have specular surfaces and the bottom wall is matte white finish to provide evenly distributed reflected flux in the region directly above to avoid light streaking.

3. A fixture as in claim 1 wherein the ballast is located adjacent to one end of said tubes and is oriented transversely to and with its thinest dimension perpendicular to the tubes.

4. A fixture as in claim 1 wherein the housing has a pair of end walls and the ballast has width and height dimensions the shortest of these being between the end of the tubes and an end wall to enhance the light distribution and insure uniformity in a plurality of end to end fixture installations.

5. A fixture as in claim 1 wherein the lamps are mounted one above another whereby the upper lamp redirects the upward flux from the lower lamp so that only flux from the upper lamp is emitted upward limiting the flux directly upward to achieve minimum luminance on the ceiling.

* * * * *